US008870716B2

(12) United States Patent
Murray et al.

(10) Patent No.: US 8,870,716 B2
(45) Date of Patent: Oct. 28, 2014

(54) COAXIAL LOAD WHEEL AND CRANKS

(75) Inventors: Brian Murray, Shalu (TW); Kuang-Shiung Kao, Taichung County (TW)

(73) Assignee: Dyaco International, Inc., Taipei (TW)

( * ) Notice: Subject to any disclaimer, the term of this patent is extended or adjusted under 35 U.S.C. 154(b) by 281 days.

(21) Appl. No.: 13/241,841

(22) Filed: Sep. 23, 2011

(65) Prior Publication Data

US 2012/0015782 A1 Jan. 19, 2012

Related U.S. Application Data

(63) Continuation of application No. 12/321,905, filed on Jan. 27, 2009, now Pat. No. 8,051,752.

(51) Int. Cl.

| | |
|---|---|
| ***A63B 21/00*** | (2006.01) |
| ***A63B 22/00*** | (2006.01) |
| ***A63B 21/22*** | (2006.01) |
| *A63B 22/06* | (2006.01) |

(52) U.S. Cl.

CPC ..... *A63B 21/225* (2013.01); *A63B 21/15* (2013.01); *A63B 2022/067* (2013.01); *A63B 22/001* (2013.01)

USPC ..... 482/51; 482/52; 482/71

(58) Field of Classification Search

USPC ..... 482/57, 51, 52, 54

See application file for complete search history.

(56) References Cited

U.S. PATENT DOCUMENTS

| | | | |
|---|---|---|---|
| D319,275 | S | 8/1991 | Hurt |
| 5,078,390 | A | 1/1992 | Hurt |
| 5,254,059 | A | 10/1993 | Arthur et al. |
| 5,302,162 | A | 4/1994 | Pasero |
| 5,451,070 | A | 9/1995 | Lindsay et al. |
| 5,833,577 | A | 11/1998 | Hurt |
| 6,241,638 | B1 | 6/2001 | Hurt |
| 7,060,005 | B2 | 6/2006 | Carlsen et al. |
| 7,077,789 | B1 | 7/2006 | Chen |
| 7,104,929 | B1 | 9/2006 | Eschenbach |
| 7,153,239 | B1 | 12/2006 | Stearns et al. |
| 7,223,209 | B2 | 5/2007 | Lee |

(Continued)

FOREIGN PATENT DOCUMENTS

| | | |
|---|---|---|
| WO | WO-2007055937 A1 | 5/2007 |
| WO | WO-2007056136 A1 | 5/2007 |

OTHER PUBLICATIONS

U.S. Appl. No. 13/012,455, filed Jan. 24, 2011, Murray.

*Primary Examiner* — Jerome w Donnelly
(74) *Attorney, Agent, or Firm* — Perkins Coie LLP

(57) ABSTRACT

An exercise machine includes a base, an axle rotationally supported on the base and two cranks connected to the axle. The cranks are rotational synchronously with the axle. A drive wheel unit includes an active wheel provided on the axle so that the active wheel is rotational synchronously with the cranks. A passive wheel unit includes a load wheel supported on the axle so that the load wheel is rotational relative to the axle and a passive connected to the load wheel so that the passive wheel is rotational synchronously with the load wheel. A step-up device includes a shaft rotationally supported on the base and small and large wheels connected to the shaft so that they are rotational synchronously. The small wheel is connected to the active wheel so that they are rotational together. The large wheel is connected to the passive wheel so that they are rotational together.

19 Claims, 8 Drawing Sheets

(56) References Cited

U.S. PATENT DOCUMENTS

| | | | |
|---|---|---|---|
| 7,244,218 | B1 | 7/2007 | Lin et al. |
| 7,270,626 | B2 | 9/2007 | Porth |
| 7,361,122 | B2 | 4/2008 | Porth |
| D606,599 | S | 12/2009 | Murray et al. |
| 7,654,936 | B2 | 2/2010 | Liao et al. |
| 7,682,290 | B2 | 3/2010 | Liao et al. |
| 7,691,035 | B2 | 4/2010 | Chen et al. |
| 7,722,505 | B2 | 5/2010 | Liao et al. |
| 7,846,071 | B2 | 12/2010 | Fenster et al. |
| 8,051,752 | B2 | 11/2011 | Murray et al. |
| 2002/0070550 | A1 | 6/2002 | Lin et al. |
| 2002/0137601 | A1 | 9/2002 | Tobias et al. |
| 2005/0049117 | A1 | 3/2005 | Rodgers |
| 2006/0009330 | A1 | 1/2006 | Lo |
| 2006/0166791 | A1 | 7/2006 | Liao et al. |
| 2007/0179023 | A1 | 8/2007 | Dyer |
| 2007/0232465 | A1* | 10/2007 | Puzey ..... 482/110 |
| 2007/0298935 | A1 | 12/2007 | Badarneh et al. |
| 2008/0051258 | A1 | 2/2008 | Schmehl et al. |

* cited by examiner

COAXIAL LOAD WHEEL AND CRANKS

CROSS-REFERENCE TO RELATED APPLICATION(S)

This application is a continuation of U.S. patent application Ser. No. 12/321,905 filed Jan. 27, 2009, which application is incorporated herein by reference in its entirety.

TECHNICAL FIELD

The present invention relates to an exercise machine and, more particularly, to an exercise machine with coaxial load wheel and cranks.

BACKGROUND

The environment is changing so that there is less and less space for people to exercise in. The society is also changing so that there is less and less time left for people to exercise. Therefore, people exercise less and less, and this jeopardizes physical and mental health. According to reports, light and frequent exercise improves human health as well as more intense but less frequent exercise. To facilitate exercise, there have been various exercise machines. With these exercise machines, people can exercise whenever they are available.

A typical exercise bike or oval-movement exercise machine includes two cranks, an active wheel and a load wheel. The cranks are connected to the active wheel. The active wheel is connected to the load wheel via an ordinary belt, a timing belt or chain. The load wheel exerts a load on the active wheel through the belt while a user is working out. The load wheel may include external or internal magnets or frictional elements. The active wheel and the load wheel are provided on two different axles, and this renders the exercise bike or oval-movement exercise machine bulky. The bulkiness intimidates customers who intend to use exercise machines at their not-big-enough apartments.

There have been attempts to reduce the distance between axles that support an active wheel and a load wheel and the dimensions of parts of an exercise machine. However, these attempts have not been proved to be successful.

Should the cranks be directly connected to the load wheel, i.e., without any active wheel, the rotational speed of the load wheel is the rotational speed at which a user treads the cranks. The rotational speed of the load wheel would be too low, i.e., the rotational momentum of the load wheel would be too small to ensure smooth rotation of the load wheel, particularly near upper and lower dead points.

The present invention is therefore intended to obviate or at least alleviate the problems encountered in prior art.

SUMMARY

It is the primary objective of the present invention to provide an exercise with coaxial load wheel and cranks.

According to the present invention, an exercise machine includes a base, an axle rotationally supported on the base and two cranks connected to the axle so that the cranks are rotational synchronously with the axle. A drive wheel unit includes an active wheel provided on the axle so that the active wheel is rotational synchronously with the cranks. A passive wheel unit includes a load wheel supported on the axle so that the load wheel is rotational relative to the axle and a passive wheel connected to the load wheel so that the passive wheel is rotational synchronously with the load wheel. A step-up device includes a shaft rotationally supported on the base and small and large wheels connected to the shaft so that they are rotational synchronously. The small wheel is connected to the active wheel so that the small wheel is rotational with the active wheel. The large wheel is connected to the passive wheel so that the passive wheel is rotational with the large wheel.

Other objectives, advantages and features of the present invention will become apparent from the following description referring to the attached drawings.

BRIEF DESCRIPTION OF THE DRAWINGS

The present invention will be described via detailed illustration of embodiments referring to the drawings.

DETAILED DESCRIPTION

Figure 1:
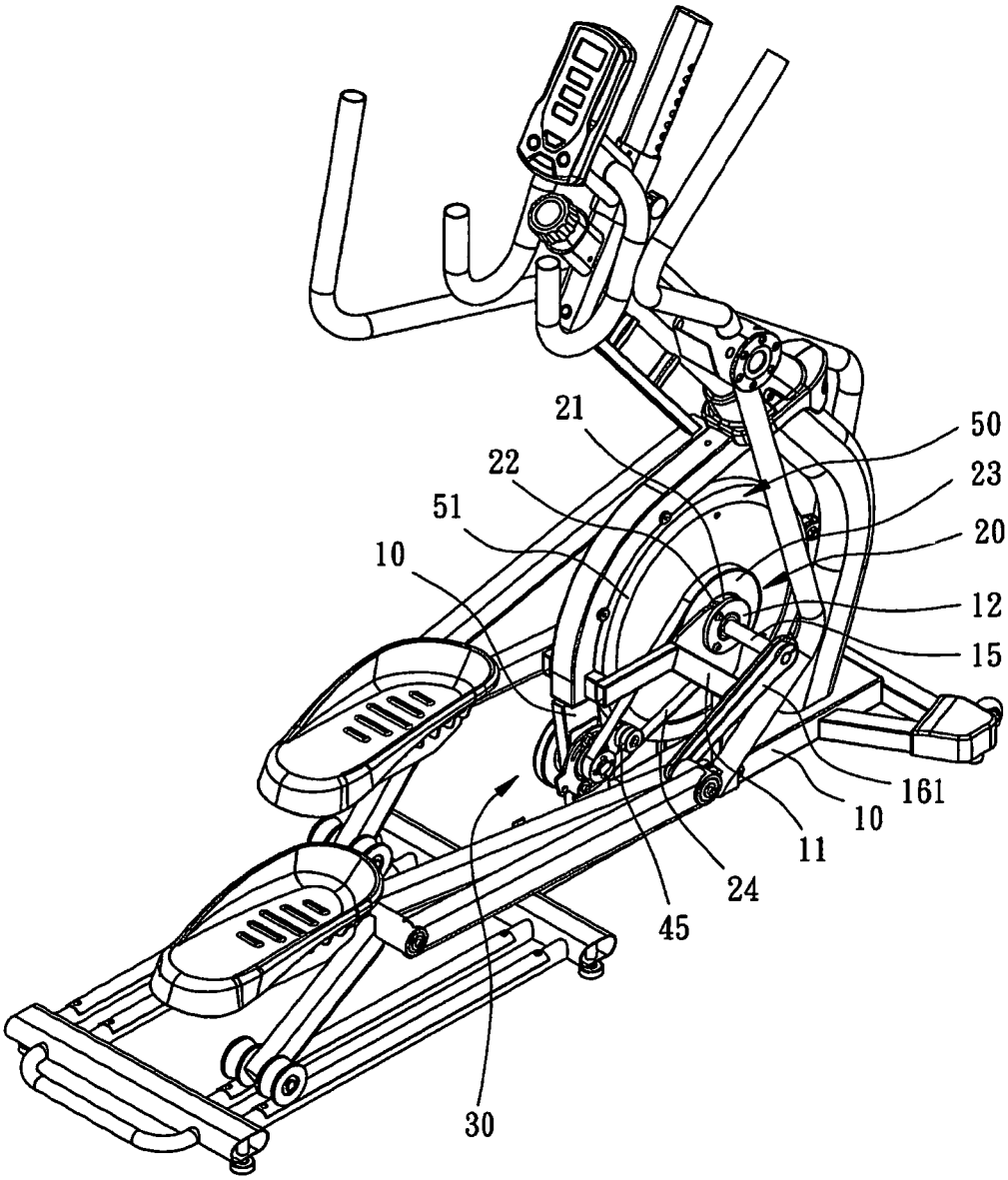
FIG. 1 is a perspective view of an oval-movement exercise machine according to a first embodiment of the present invention.

Referring to FIG. 1, there is shown an oval-movement exercise machine according to a first embodiment of the present invention. The oval-movement exercise machine includes a base 10, a drive wheel unit 20 located on the base 10, a load wheel unit 50 coaxial with the drive wheel unit 20 and a step-up device 30 for connecting the drive wheel unit 20 to the load wheel unit 50.

Figure 2:
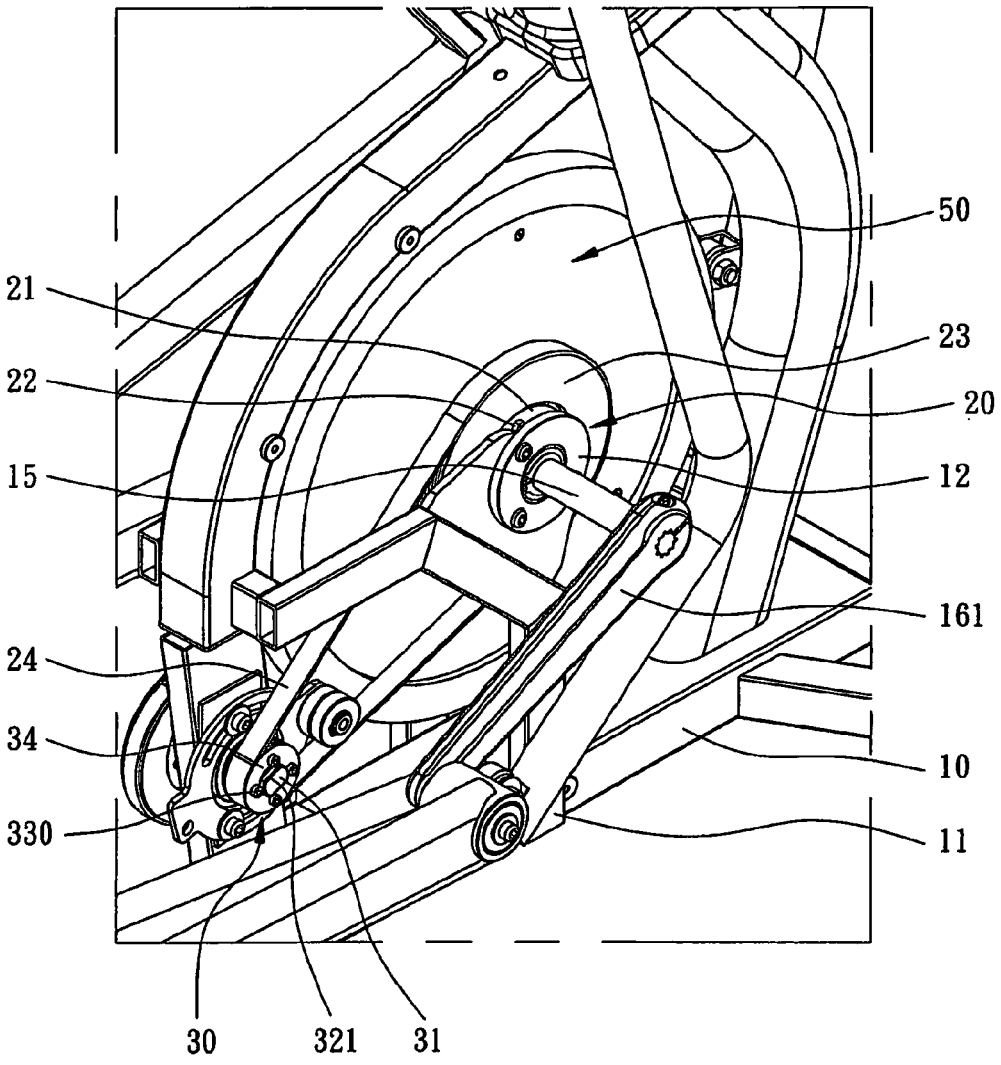
FIG. 2 is an enlarged view of the oval-movement exercise machine shown in FIG. 1
Figure 3:
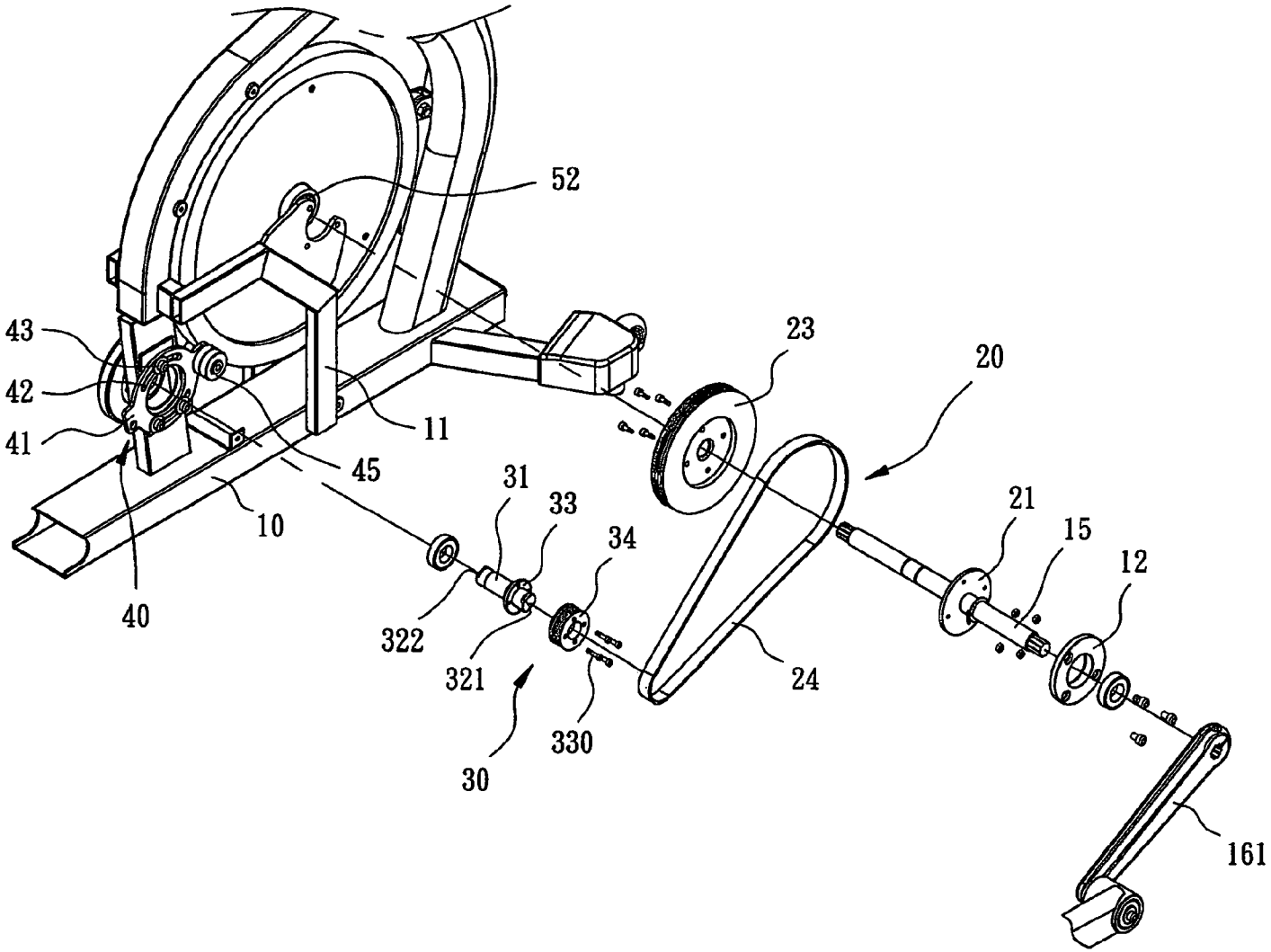
FIG. 3 is an exploded view of the oval-movement exercise machine shown in FIG. 2.
Figure 4:
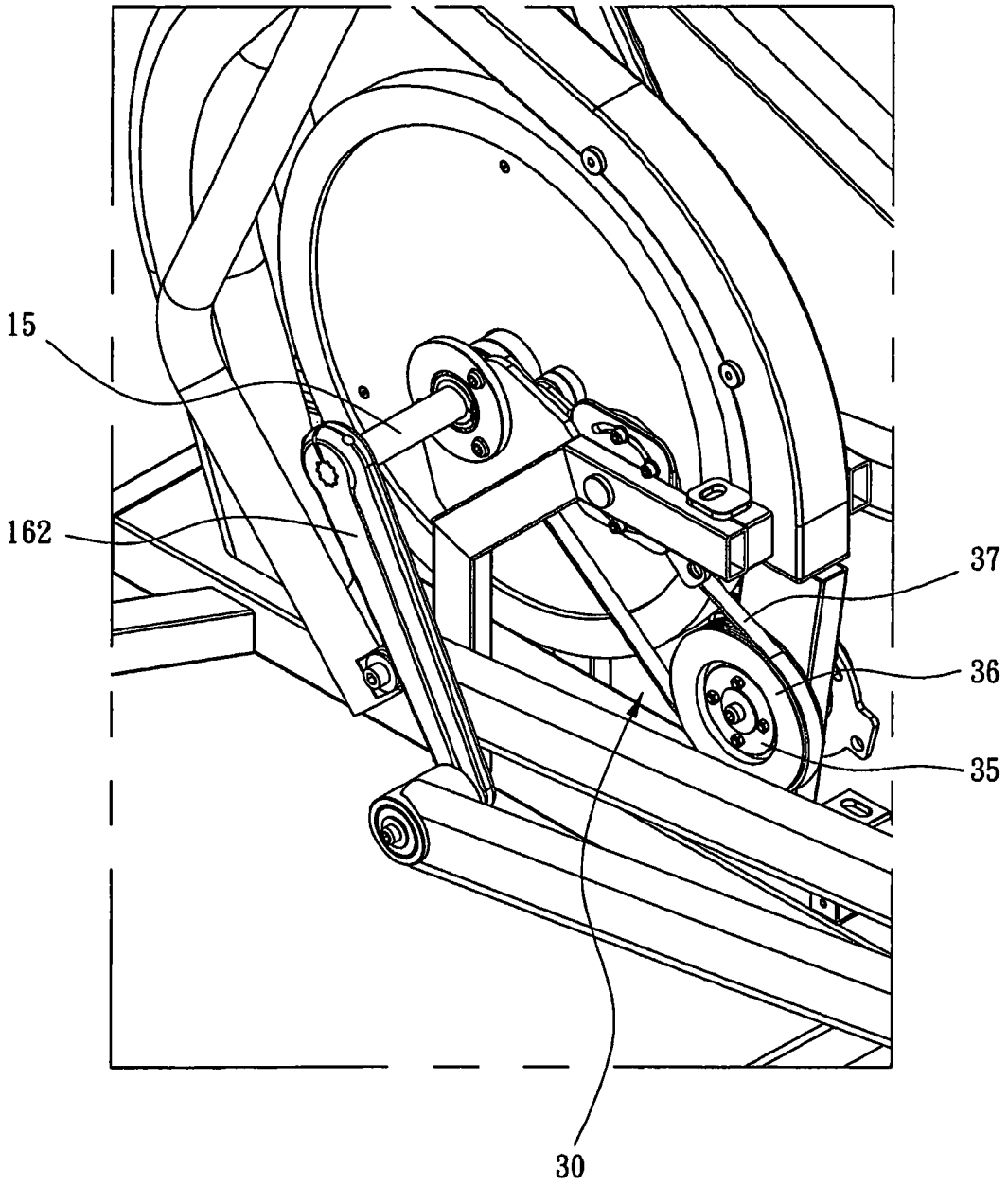
FIG. 4 is another enlarged view of the oval-movement exercise machine shown in FIG. 1.

Referring to FIGS. 2 through 4, the base 10 includes two rods 11 provided thereon and two bearings 12 each attached to a related one of the rods 11. An axle 15 is supported on the bearings 12. An end of a crank 161 is connected to an end of the axle 15 while an end of another crank 162 is connected to another end of the axle 15. Another end of the crank 161 is connected to a pedal-supporting keel of an oval-movement mechanism. Another end of the crank 162 is connected to another pedal-supporting keel of the oval-movement mechanism. Thus, two pedals of the oval-movement mechanism can be trod to rock the cranks 161 and 162 to spin the axle 15.

The drive wheel unit 20 includes a ring 21 secured to the axle 15 by welding for example and an active wheel 23 connected to the ring 21 with fasteners 22 such as screws. Thus, the active wheel 23 is rotational synchronously with the cranks 161 and 162.

Figure 5:
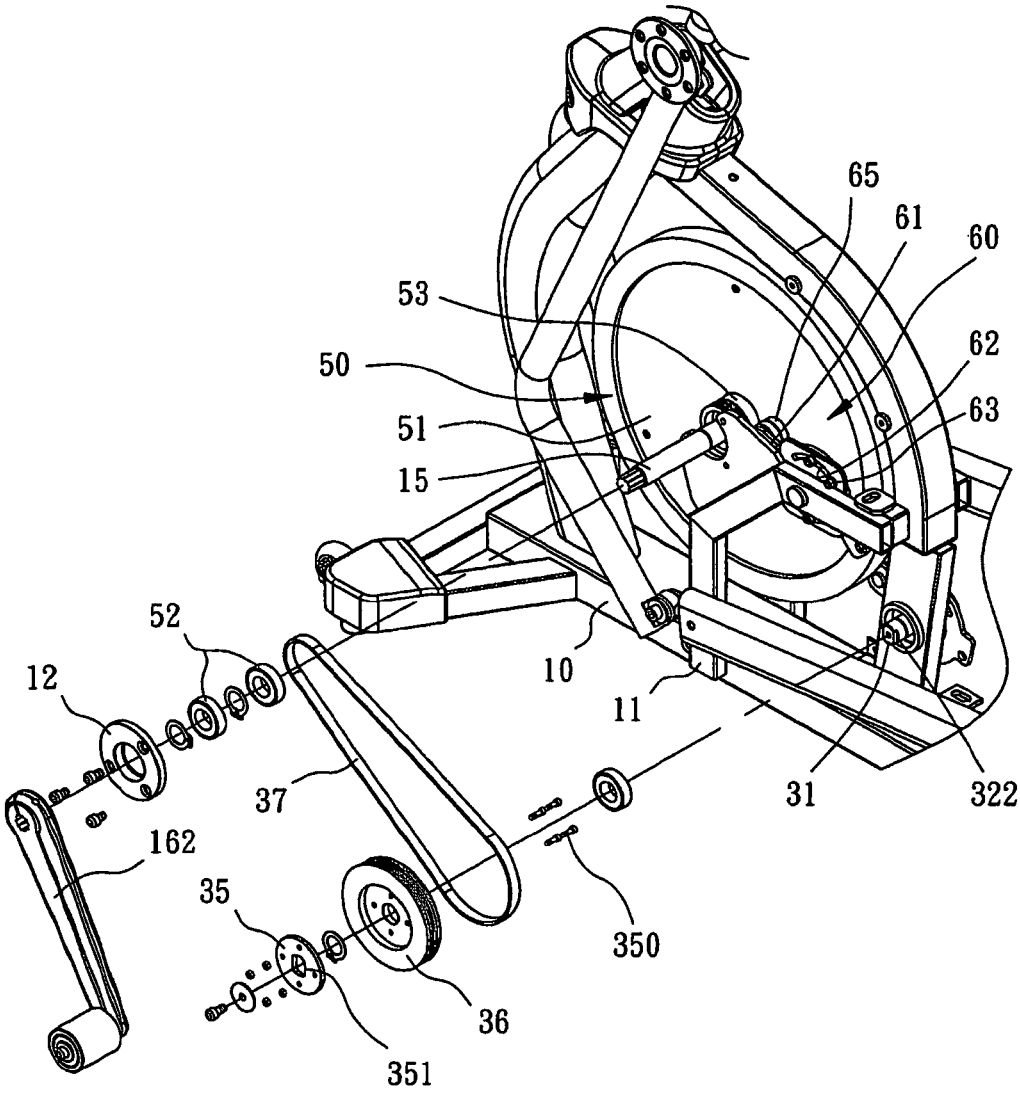
FIG. 5 is an exploded view of the oval-movement exercise machine shown in FIG. 4.
Figure 6:
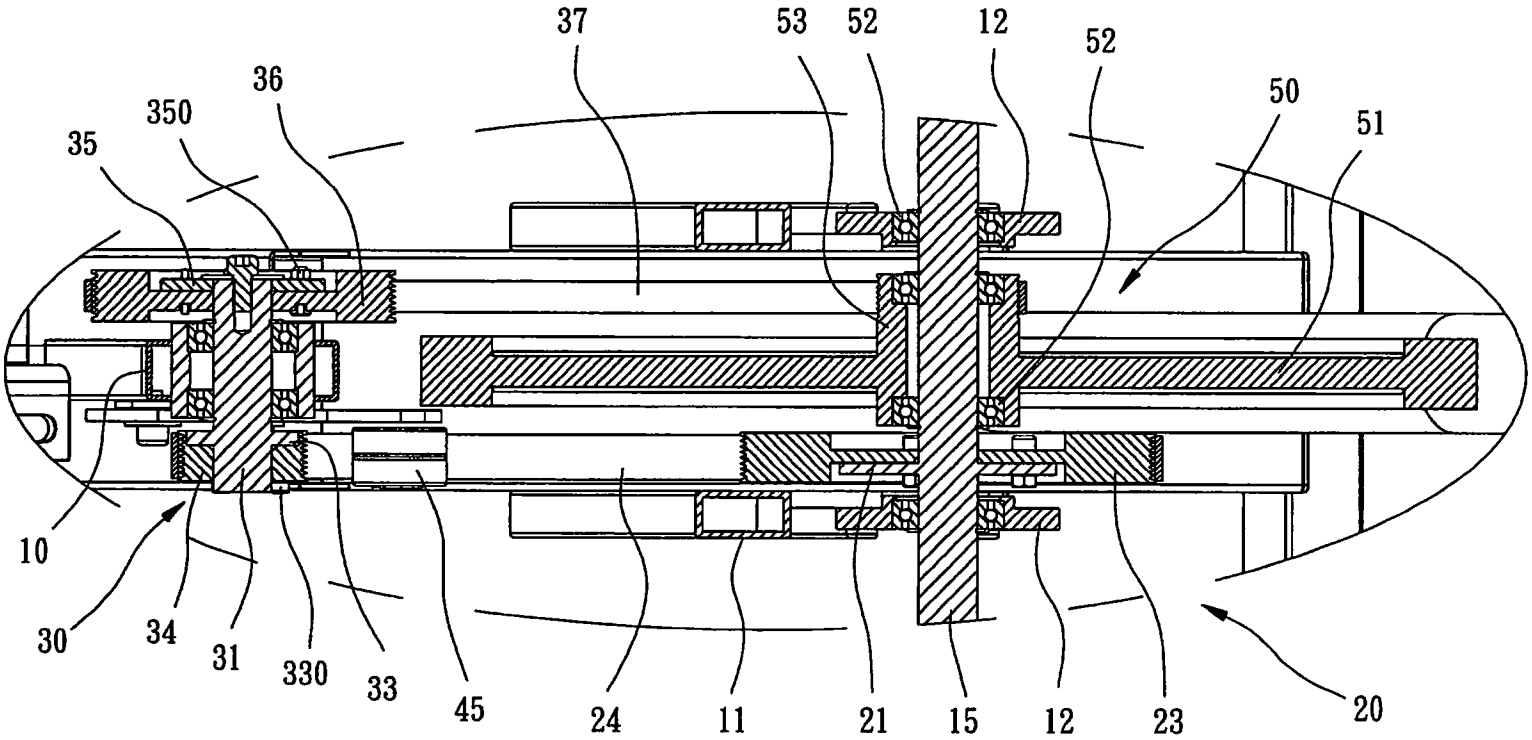
FIG. 6 is a cross-sectional view of the oval-movement exercise machine shown in FIG. 1.

Referring to FIGS. 4 through 6, the load wheel unit 50 includes a load wheel 51, a bearing 52 for supporting the load wheel 51 on the axle 15 and a passive wheel 53 attached to the load wheel 51. Thus, the load wheel 51 is rotational relative to the axle 15 while the passive wheel 53 is rotational synchronously with the load wheel 51. The load wheel 51 exerts a load while a user is working out on the oval-movement exercise machine. The load wheel 51 may include internal or external magnets or frictional elements.

As clearly shown in FIGS. 3 and 6, the step-up device 30 includes an shaft 31 formed with two flat ends 321 and 322. A ring 33 is secured to the shaft 31 by welding for example. A small wheel 34 is connected to the ring 33 with fasteners 330 such as screws so that the small wheel 34 is rotational synchronously with the shaft 31.

A transmitting element 24 is arranged between the small wheel 34 and the active wheel 23 so that power can be transmitted to the small wheel 34 from the active wheel 23 via the transmitting element 24. The transmitting element 24 may be an ordinary belt, a timing belt or a chain. The small wheel 34 and the active wheel 23 may be pulleys, timing pulleys or sprockets corresponding to the transmitting element 24. The transmitting element 24 is preferably an ordinary belt wound around the small wheel 34 and the active wheel 23 embodied as pulleys.

The diameter of the active wheel 23 is at least twice as large as that of the small wheel 34. Preferably, the diameter of the active wheel 23 is three times as large as that of the small wheel 34. Therefore, the rotational rate of the small wheel 34 is three times as large as that of the active wheel 23.

As clearly shown in FIGS. 5 and 6, a large wheel 36 is connected to a ring 35 with fasteners 350 such as screws. The ring 35 includes a slot 351 defined therein corresponding to the flat end 322 of the shaft 31. The large wheel 36 and the ring 35 are located on the shaft 31. The flat end 322 of the shaft 31 is inserted in the slot 351 so that the large wheel 36 is rotational synchronously with the shaft 31. A washer is used with a fastener such as a screw to keep the ring 35 on the shaft 31.

A transmitting element 37 is arranged between the large wheel 36 and the passive wheel 53 so that power can be transmitted to the passive wheel 53 from the large wheel 36 via the transmitting element 37. The transmitting element 37 may be an ordinary belt, a timing belt or a chain. The large wheel 36 and the passive wheel 53 may be pulleys, timing pulleys or sprockets corresponding to the transmitting element 37. The transmitting element 37 is preferably an ordinary belt wound around the large wheel 36 and the passive wheel 53 embodied as pulleys.

The diameter of the large wheel 36 is at least twice as large as that of the passive wheel 53. Preferably, the diameter of the large wheel 36 is three times as large as that of the passive wheel 53. Hence, the rotational rate of the passive wheel 53 is three times as high as that of the large wheel 36.

As discussed above, the rotational rate of the load wheel 51 is nine times as high as that of the cranks 161 and 162 because of the step-up device 30.

Referring to FIG. 3, there is a tensioning device 40 for helping to load the transmitting element 24 with appropriate tension. The tensioning device 40 includes a ring 41 and an idle wheel 45. The ring 41 includes two arched slots 42 defined therein. A fastener 43 is inserted through each of the arched slots 42 and driven into a stud raised from the base 10. The idle wheel 45 is supported on the ring 41. The idle wheel 45 is abutted against the transmitting element 24. If the transmitting element 24 gets slack after some time of use, the arched slots 42 will allow the angle of the ring 41 to be adjusted to abut the idle wheel 45 against the transmitting element 24 properly again.

Referring to FIG. 5, there is a tensioning device 60 for helping to load the transmitting element 37 with appropriate tension. The tensioning device 60 includes a ring 61 and an idle wheel 65. The ring 61 includes two arched slots 62 defined therein. A fastener 63 is inserted through each of the arched slots 62 and driven into the stud. The idle wheel 65 is supported on the ring 61. The idle wheel 65 is abutted against the transmitting element 37. If the transmitting element 37 gets slack after some time of use, the arched slots 62 will allow the angle of the ring 61 to be adjusted to abut the idle wheel 65 against the transmitting element 37 properly again.

Figure 7:
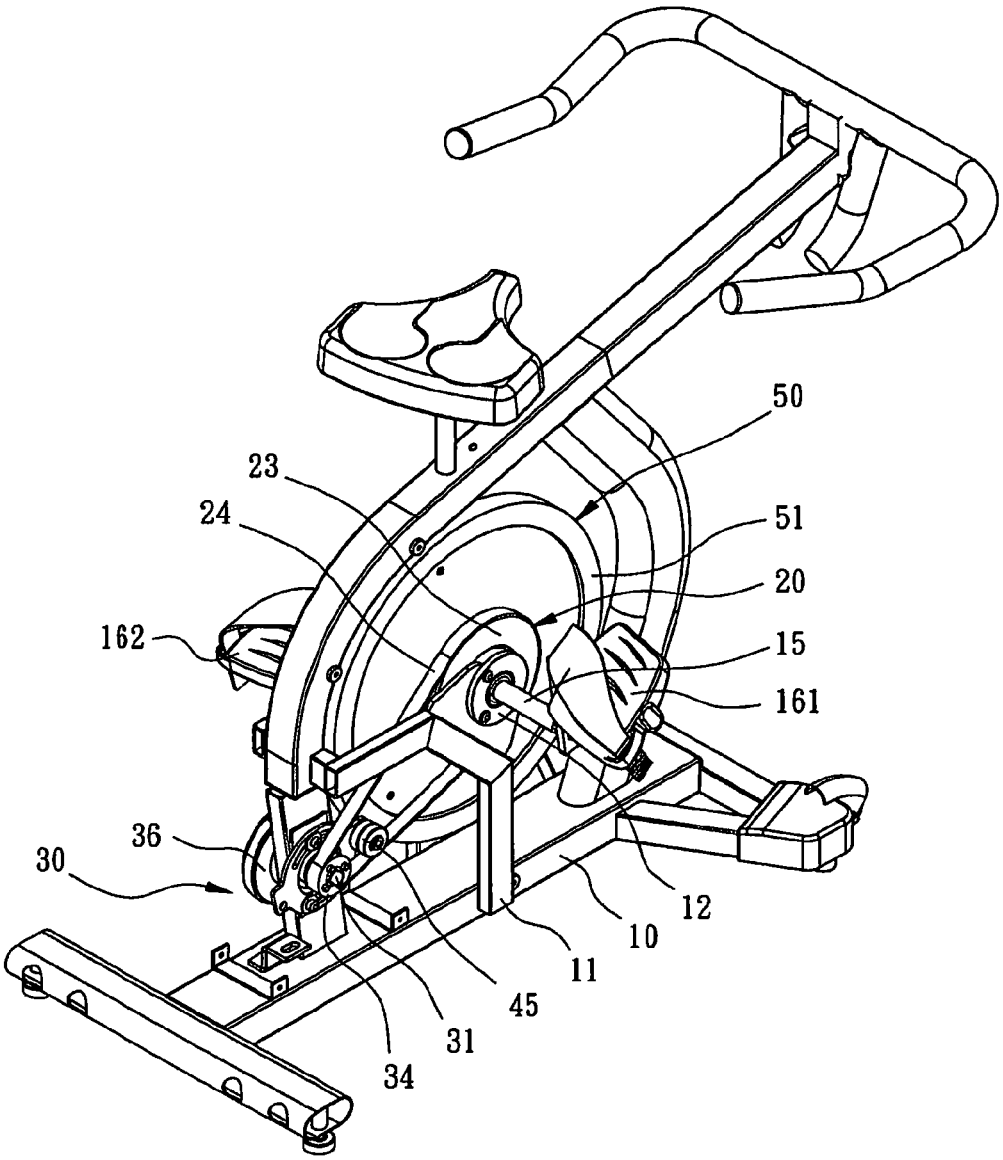
FIG. 7 is a perspective view of an exercise bike according to a second embodiment of the present invention.
Figure 8:
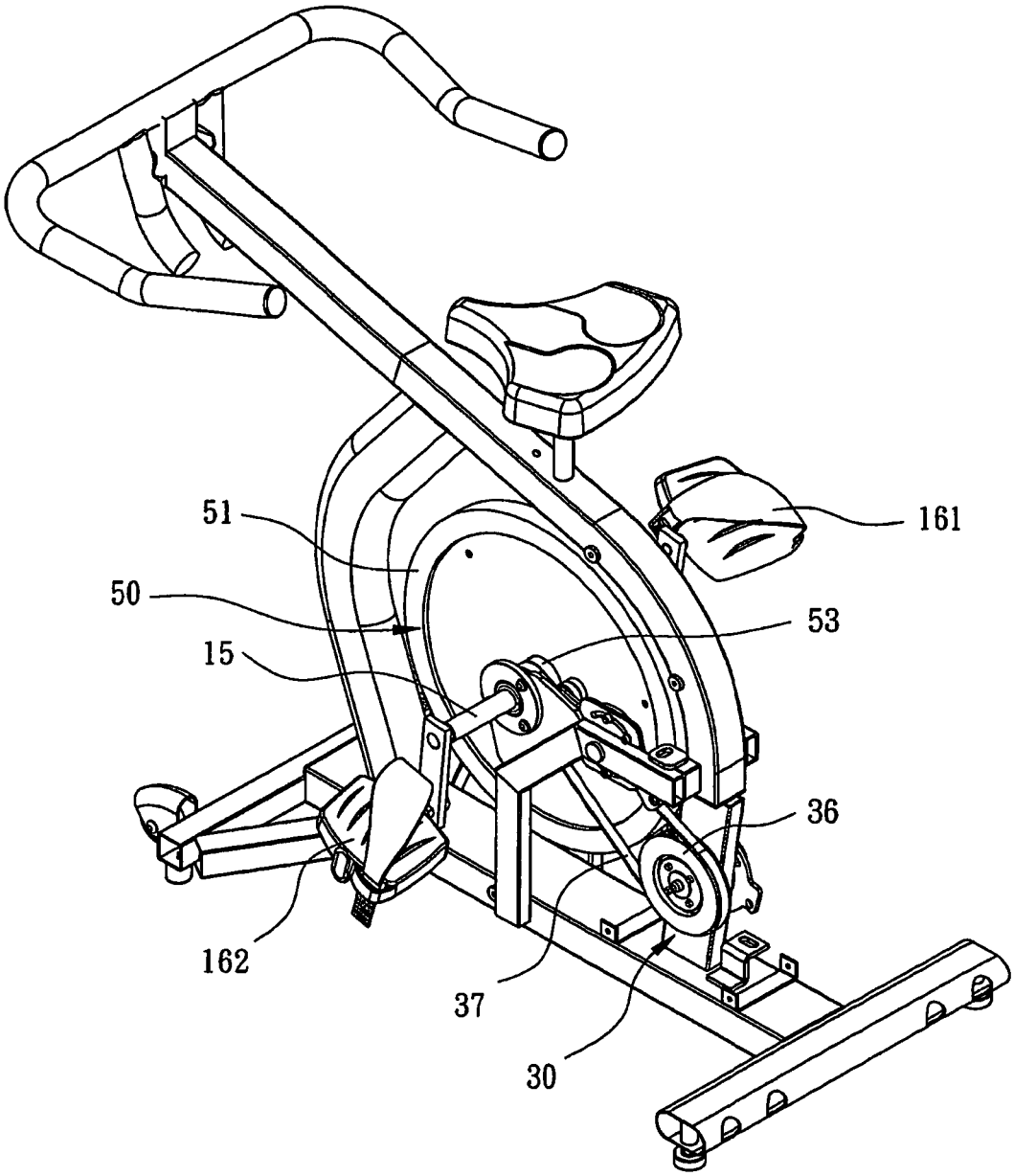
FIG. 8 is another perspective view of the exercise bike of FIG. 7.

Referring to FIGS. 7 and 8, there is shown an exercise bike according to a second embodiment of the present invention. The second embodiment is like the first embodiment except omitting the oval-movement mechanism. In the second embodiment, a pedal is connected to each of the cranks 161 and 162.

The present invention has been described via the detailed illustration of the embodiments. Those skilled in the art can derive variations from the embodiments without departing from the scope of the present invention. Therefore, the embodiments shall not limit the scope of the present invention defined in the claims.

We claim:

1. An exercise machine comprising:

a base;

an axle rotationally supported on the base;

a first crank operably coupled to a first end portion of the axle;

a second crank operably coupled to a second end portion of the axle;

an active wheel fixedly mounted to the axle and rotational synchronously therewith, wherein the active wheel is rotationally driven by the first and second cranks;

a small wheel operably coupled to the active wheel and rotationally driven thereby;

a large wheel operably coupled to the small wheel and rotational synchronously therewith;

a load wheel rotationally mounted to the axle and rotational relative to the axle and the active wheel, wherein the load wheel is operably coupled to the large wheel and rotationally driven thereby; and a shaft rotationally supported on the base and spaced apart from the axle, wherein the small wheel and the large wheel are coaxially mounted to the shaft and rotational synchronously therewith.

2. An exercise machine comprising;

a base;

an axle rotationally supported on the base;

a first crank operably coupled to a first end portion of the axle;

second crank operably coupled to a second end portion of the axle;

an active wheel fixedly mounted to the axle and rotational synchronously therewith, wherein the active wheel is rotationally driven by the first and second cranks;

a small wheel operably coupled to the active wheel and rotationally driven thereby;

a large wheel operably coupled to the small wheel and rotational synchronously therewith;

a load wheel rotationally mounted to the axle and rotational relative to the axle and the active wheel, wherein the load wheel is operably coupled to the large wheel and rotationally driven thereby;

a first transmitting element operably coupling the active wheel to the small wheel; and a second transmitting element operably coupling the large wheel to the load wheel.

3. The exercise machine of claim 1, further comprising:

a first belt operably coupling the active wheel to the small wheel in a first step-up relationship; and a second belt operably coupling the large wheel to the load wheel in a second step-up relationship.

4. The exercise machine of claim 2 wherein the active wheel is operably coupled to the load wheel in a step-up relationship.

5. An exercise machine comprising:

a base;

an axle rotationally supported on the base;

a first crank operably coupled to a first end portion of the axle;

a second crank operably coupled to a second end portion of the axle;

an active wheel fixedly mounted to the axle and rotational synchronously therewith, wherein the active wheel is rotationally driven by the first and second cranks;

a small wheel operably coupled to the active wheel and rotationally driven thereby;

a large wheel operably coupled to the small wheel and rotational synchronously therewith;

a load wheel rotationally mounted to the axle and rotational relative to the axle and the active wheel, wherein the load wheel is operably coupled to the large wheel and rotationally driven thereby; and a passive wheel coaxially connected to the load wheel and rotational synchronously therewith, wherein the large wheel is operably coupled to the load wheel via the passive wheel.

6. The exercise machine of claim 5 wherein the first crank is fixedly attached to the first end portion of the axle and the second crank is fixedly attached to the second end portion of the axle.

7. The exercise machine of claim 5, further comprising:

a first oval-movement mechanism operably coupled to the first crank; and a second oval-movement mechanism operably coupled to the second crank.

8. The exercise machine of claim 1, further comprising:

a first pedal-supporting keel operably coupled to the first crank; and a second pedal-supporting keel operably coupled to the second crank.

9. The exercise machine of claim 2, wherein the active wheel has a first diameter and the small wheel has a second diameter that is smaller than the first diameter.

10. The exercise machine of claim 5 wherein the passive wheel has a first diameter and the large wheel has a second diameter that is larger than the first diameter.

11. The exercise machine of claim 5 wherein the passive wheel has a first diameter and the large wheel has a second diameter that is larger than the first diameter; and wherein the small wheel has a third diameter and the active wheel has a fourth diameter that is larger than the third diameter.

12. The exercise machine of claim 5 wherein the passive wheel has a first diameter and the large wheel has a second diameter that is larger than the first diameter;

wherein the small wheel has a third diameter that is less than the second diameter; and wherein the active wheel has a fourth diameter that is larger than the third diameter.

13. An exercise machine comprising:

a base;

an axle rotationally supported on the base;

a first crank operably coupled to the axle;

a second crank operably coupled to the axle;

a drive wheel unit comprising an active wheel coaxially mounted to the axle and rotational synchronously therewith, wherein the active wheel is rotationally driven by movement of the first and second cranks;

a passive wheel unit comprising a load wheel coaxially mounted to the axle and rotational relative to the axle; and means for stepping-up rotation of the load wheel relative to the active wheel.

14. The exercise machine of claim 13 wherein the means for stepping-up rotation of the load wheel relative to the active wheel include means for rotating the active wheel at a first speed and rotating the load wheel at a second speed, greater than the first speed.

15. The exercise machine of claim 13 wherein the means for stepping-up include:

a rotational shaft spaced apart from the axle;

a small wheel coaxially mounted to the shaft and rotational synchronously therewith, wherein the small wheel is driven by the active wheel; and a large wheel coaxially mounted to the shaft and rotational synchronously therewith, wherein the large wheel drives the load wheel.

16. The exercise machine of claim 13 wherein the means for stepping-up include:

a rotational shaft spaced apart from the axle;

a small wheel coaxially mounted to the shaft and rotational synchronously therewith;

a large wheel coaxially mounted to the shaft and rotational synchronously therewith;

means for transmitting power from the active wheel to the small wheel; and means for transmitting power from the large wheel to the load wheel.

17. The exercise machine of claim 13 wherein the means for stepping-up include:

a small wheel coaxially mounted to a shaft and rotational synchronously therewith;

a large wheel coaxially mounted to the shaft and rotational synchronously therewith;

a transmitting element directly coupling the active wheel to the small wheel;

means for adjusting tension in the transmitting element; and means for transmitting power from the large wheel to the load wheel.

18. The exercise machine of claim 13 wherein the means for stepping-up include:

a small wheel coaxially mounted to a shaft and rotational synchronously therewith;

a large wheel coaxially mounted to the shaft and rotational synchronously therewith;

a first transmitting element drivably coupling the active wheel to the small wheel;

a second transmitting element drivably coupling the large wheel to the load wheel;

means for adjusting tension in the first transmitting element; and means for adjusting tension in second transmitting element.

19. The exercise machine of claim 18 wherein the active wheel and the load wheel are coaxilly mounted to the axial.

* * * * *

UNITED STATES PATENT AND TRADEMARK OFFICE

CERTIFICATE OF CORRECTION

PATENT NO. : 8,870,716 B2
APPLICATION NO. : 13/241841
DATED : October 28, 2014
INVENTOR(S) : Brian Murray et al.

It is certified that error appears in the above-identified patent and that said Letters Patent is hereby corrected as shown below:

In the Specification

In column 2, line 20, delete "1" and insert -- 1. --, therefor.

In the Claims

In column 4, line 41, in claim 2, delete "comprising;" and insert -- comprising: --, therefor.

In column 4, line 46, in claim 2, before "second" insert -- a --, therefor.

Signed and Sealed this
Seventeenth Day of March, 2015

Michelle K. Lee

Michelle K. Lee
*Director of the United States Patent and Trademark Office*